US006173934B1

(12) United States Patent
Lin

(10) Patent No.: US 6,173,934 B1
(45) Date of Patent: Jan. 16, 2001

(54) CONNECTING MECHANISM

(76) Inventor: Chin-Chin Lin, 2F, No. 160, Shih Ta Road, Taipei (TW)

( * ) Notice: Under 35 U.S.C. 154(b), the term of this patent shall be extended for 0 days.

(21) Appl. No.: 09/286,937

(22) Filed: Apr. 7, 1999

(51) Int. Cl.[7] ..... E04G 3/00

(52) U.S. Cl. ..... 248/284.1; 248/286.1; 248/298.1; 248/918; 108/143; 108/145

(58) Field of Search ..... 248/284.1, 286.1, 248/298.1, 918, 291.1, 285.1; 108/143, 145, 6

(56) References Cited

U.S. PATENT DOCUMENTS

| | | | | |
|---|---|---|---|---|
| 4,616,798 | * | 10/1986 | Smeenge et al. | 248/281.1 |
| 5,681,116 | * | 10/1997 | Lin | 384/42 |
| 5,836,560 | * | 11/1998 | Kaplan et al. | 248/286.1 |
| 5,839,373 | * | 11/1998 | Lin | 108/140 |
| 5,881,984 | * | 3/1999 | Lin | 248/284.1 |
| 5,901,933 | * | 5/1999 | Lin | 248/285.1 |

* cited by examiner

*Primary Examiner*—Anita M. King

(74) *Attorney, Agent, or Firm*—Dougherty & Troxell

(57) ABSTRACT

An improved connecting mechanism includes a rotary frame, a connecting seat, and a tightening device. The rotary frame is a substantially inverted U-shaped frame having frame wings on both sides provided with symmetrical wing holes. The connecting seat is a substantially curved structure having a front end seat and a rear end seat, the front end seat being disposed between the two frame wings and formed with a through front axial hole in a transverse direction. The front axial hole has two ends each of which is provided with a recess that is further communicated radially with a groove and a sector-like end recess. Springs are fitted into the recesses, respectively, such that a spring end at one end of each of the springs is inserted into the groove, with a spring coil extending from a spring post at the other end passing through one of the end recesses to connect to one of the frame wings. The tightening device includes a shaft passing through the two wing holes, the two springs, and the front axial hole. The shaft is connected to a knob so as to be capable of abutting against or moving away from the frame wings. And when the baffle portions contact the spring posts, the connecting seat is prevented from downward displacement, ensuring that the rear end seat maintains a certain angle.

8 Claims, 4 Drawing Sheets

CONNECTING MECHANISM

BACKGROUND OF THE INVENTION (a) Field of the Invention

The present invention relates to an improved connecting mechanism, more particularly to a connecting mechanism adapted for use in keyboard supports. A connecting seat, when in a non-clamping state, will be stopped by a spring post of a spring when turning downwardly, thereby preventing collapsing of the keyboard support and hence the falling of the keyboard.

(b) Description of the Prior Art

With the popularization of personal computers, tables and racks adapted for placement of computers and their peripheral equipment are also very popular. The so-called "computer table" generally includes a table surface for placement of a monitor and an adjustable platen for placement of a keyboard. The adjustable platen operates like a drawer. It can be pulled out to allow access to the keyboard or pushed in to conceal the keyboard below the table surface.

The conventional adjustable platen can only displace forwardly and rearwardly like a drawer; its height, angle of rotation, and elevation are not adjustable. Manufacturers in the field have developed a kind of keyboard support that allows all-dimensional adjustment to match different users. For instance, U.S. Pat. No. 4,616,798 and U.S. Pat. No. 5,257,676 are directed to overcoming drawbacks of conventional adjustable platens. In addition, U.S. Pat. No. 5,839,373 and allowed U.S. Ser. No. 08/879,769 owned by the inventor of the present invention teach a connecting plate that has one end connected to a rotary device, with the other end thereof connected to an elevation device to allow elevation adjustment of a keyboard support, left and right angle displacement and adjustment of the connecting plate, height elevation adjustment of the connecting plate, etc. it can therefore be seen that the connecting mechanism plays an important role in keyboard supports.

However, there is a major drawback with the above-mentioned connecting plate. When it is desired to adjust the height elevation, it is necessary to loosen an upper screw rod and an upper knob on one side of the connecting plate. Since the elevation device on the other side of the connecting plate is connected to the keyboard support that supports the keyboard, objects on the other side of the connecting plate may, due to gravitational pull, turn downwardly and fall, resulting in falling of the keyboard, which may become damaged.

SUMMARY OF THE INVENTION

A primary object of the present invention is to provide an improved connecting mechanism to eliminate the drawback with the prior art.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
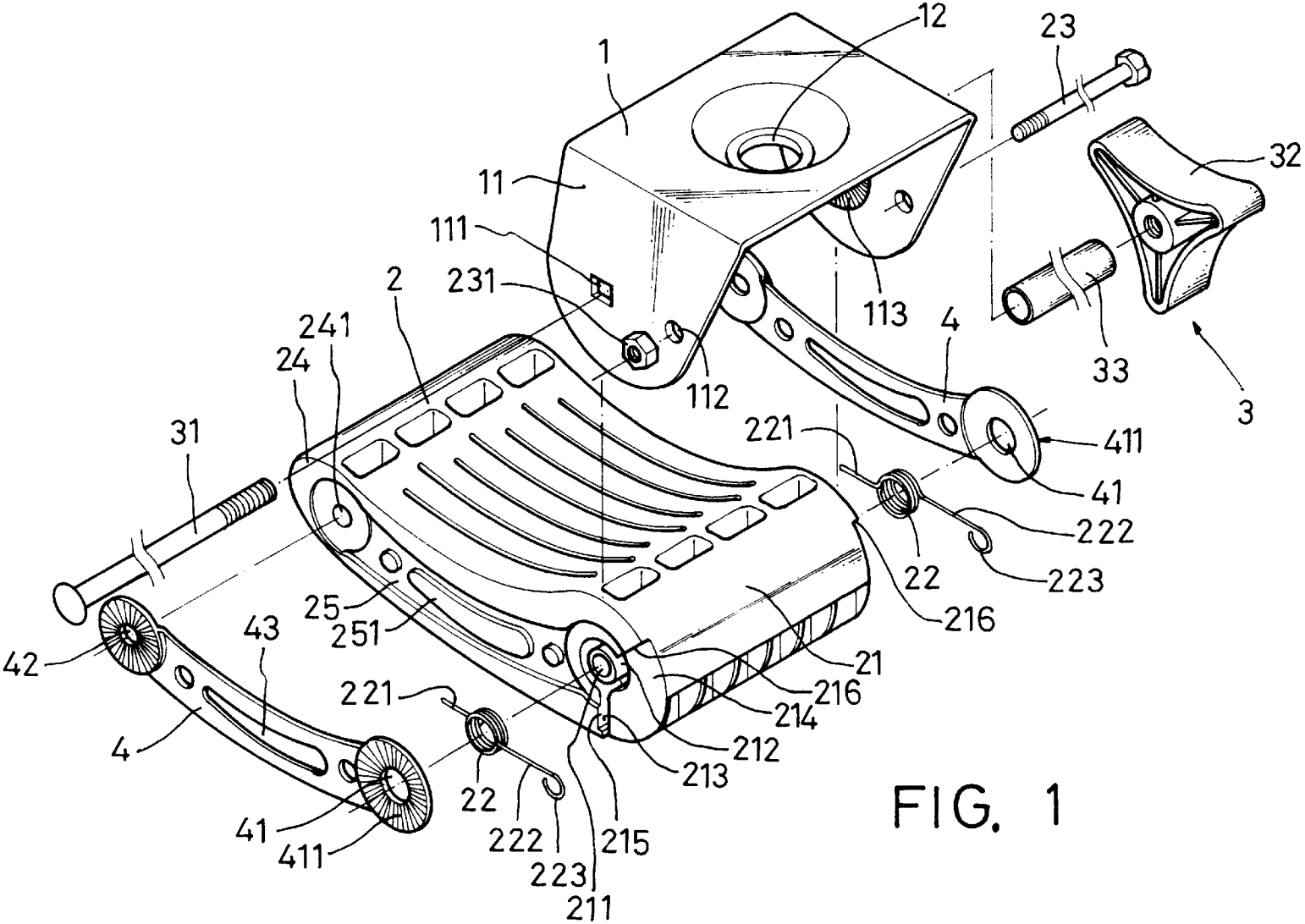
FIG. 1 is an exploded perspective view of a preferred embodiment of a connecting mechanism of the present invention.

Referring to FIGS. 1 to 4, a preferred embodiment of an improved connecting mechanism according to the present invention is shown to include a rotary frame 1, a connecting seat 2, and a tightening device 3.

The rotary frame 1 is a substantially inverted U-shaped frame that has frame wings 11 on both sides thereof, respectively. The frame wings 11 are provided with symmetrical wing holes 111, respectively. The rotary frame 1 has a top face provided with a frame hole 12 adapted to be connected with a fixed plate such as that which is disclosed in U.S. Pat. No. 5,881,984. The frame hole 12 and the fixed plate are riveted by means of a spindle disposed therebetween so that the rotary frame 1 can be rotated sideways relative to the fixed plate.

The connecting seat 2 is a curved structure that is disposed between the two frame wings 11, and that includes a front end seat 21 and a rear end seat 24. The front end seat 21 is provided with a through front axial hole 211 in a transverse direction. The front axial hole 211 has two ends each of which is provided with a recess 212 that is further communicated radially with a groove 213. A sector-like end recess 214 is further provided in a suitable position from either end of the front end seat 21 to the corresponding groove 213. The end recess 214 has a baffle portion 215 at a bottom end and an end stop portion 216 at a top end. Springs 22 are fitted into the recesses 212, respectively such that a spring end 221 at one end of each spring 22 is inserted into the groove 213, with a spring coil 223 extending from a spring post 222 at the other end thereof passing through the end recess 214 to connect to a respective one of the frame wings 11. Likewise, the rear end seat 24 is formed with a through rear axial hole 241 in a transverse direction to be adapted for connection with a rock member disclosed in said U.S. Pat. No. 5,881,984. As the present invention is not directed to the rock member, a description thereof is dispensed with herein.

The tightening device 3 includes a shaft 31 and a knob 32. The shaft 31 passes through the two wing holes 111, the two springs 22, and the front axial hole 211. The shaft 31 has a threaded section at one end that is screwably locked with the knob 32 so as to abut against the rotary frame 1 so that the connecting seat 2 is sandwiched between the frame wings 11 and can be clamped in a firm state.

As mentioned above, the spring coils 223 of the two springs 22 are connected to their corresponding frame wings 11. As in this preferred embodiment, this can be achieved by providing a through hole 112 in each frame wing 11 in an appropriate position, and a frame rod 23 having a threaded section passes through the through holes 112 and spring coils 223. The frame rod 23 is mounted on the frame wings 11 by means of a nut 231 so that the spring coils 223 are basically connected to the frame wings 11. Alternatively each frame wing 11 can be punched to form a plate groove, and a groove plate bent therefrom is connected to the corresponding spring coil 223 in a hooking manner. Certainly, the spring coils 223 and the frame wings 11 can be connected in any other way, which is within the scope of the appended claims.

Figure 2:
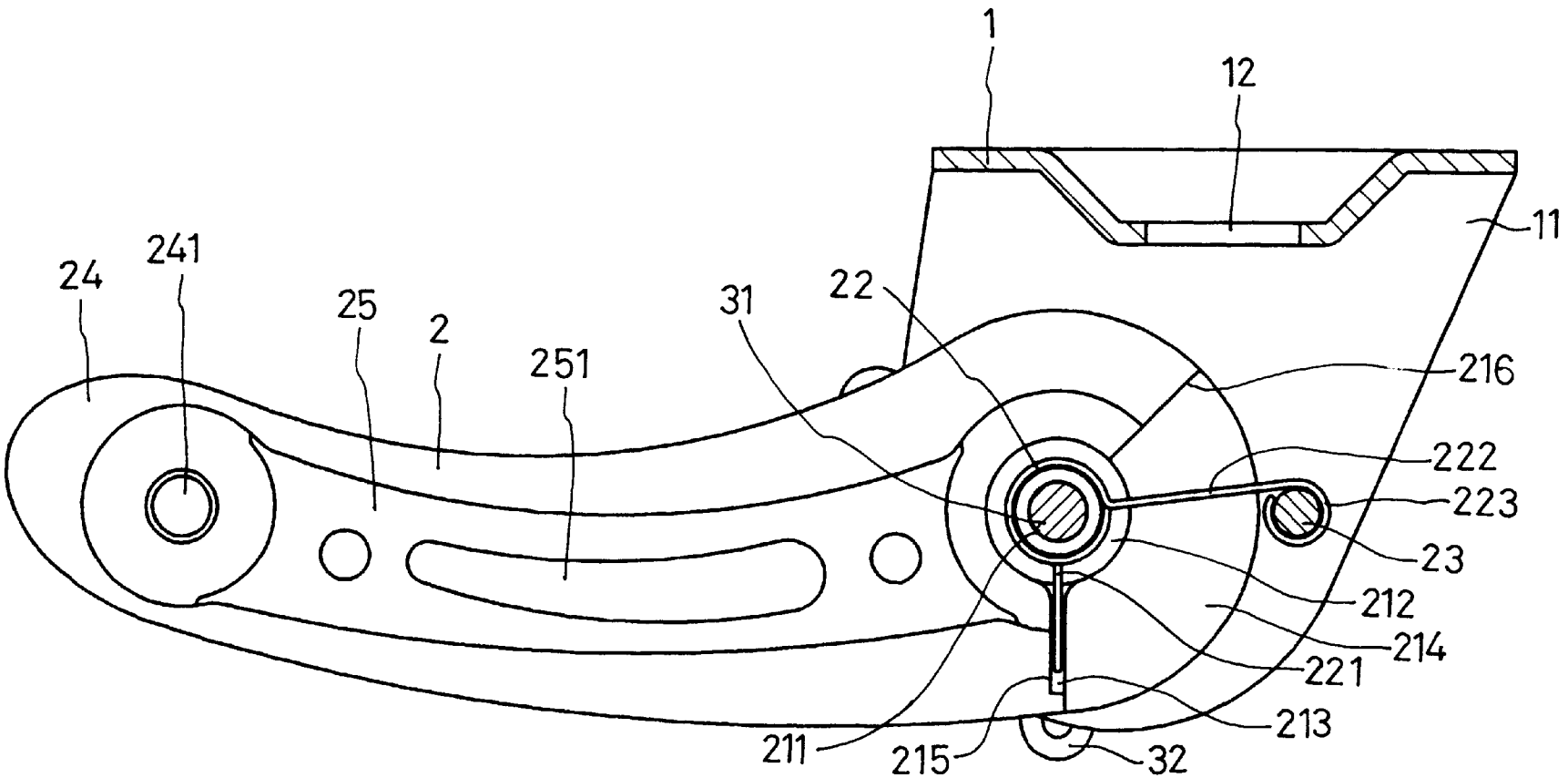
FIG. 2 is an assembled side view of the preferred embodiment, showing a connecting seat in a clamped state.
Figure 3:
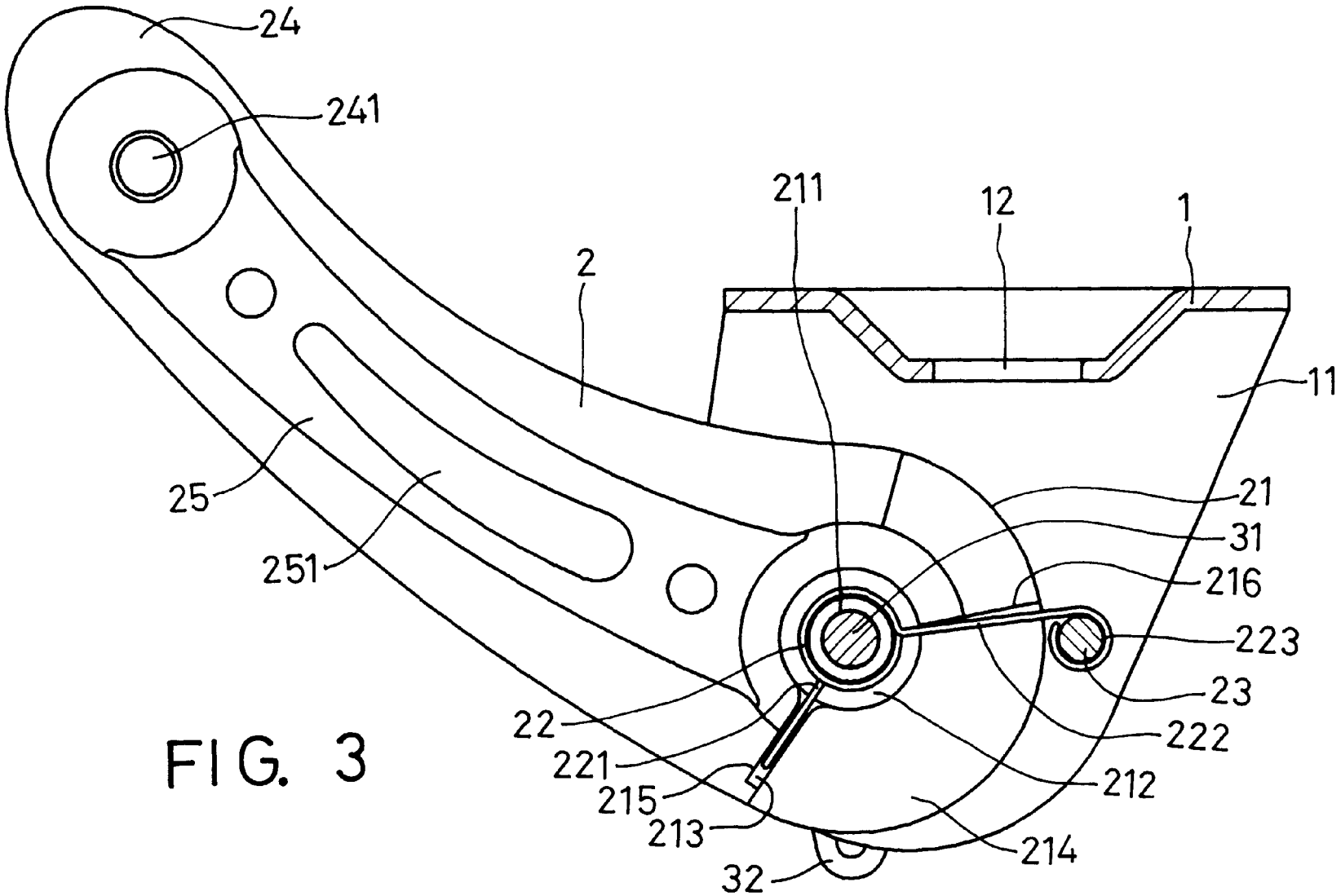
FIG. 3 is an assembled side view of the preferred embodiment, showing operation of the connecting seat when a tightening device is not in a tightened state.
Figure 4:
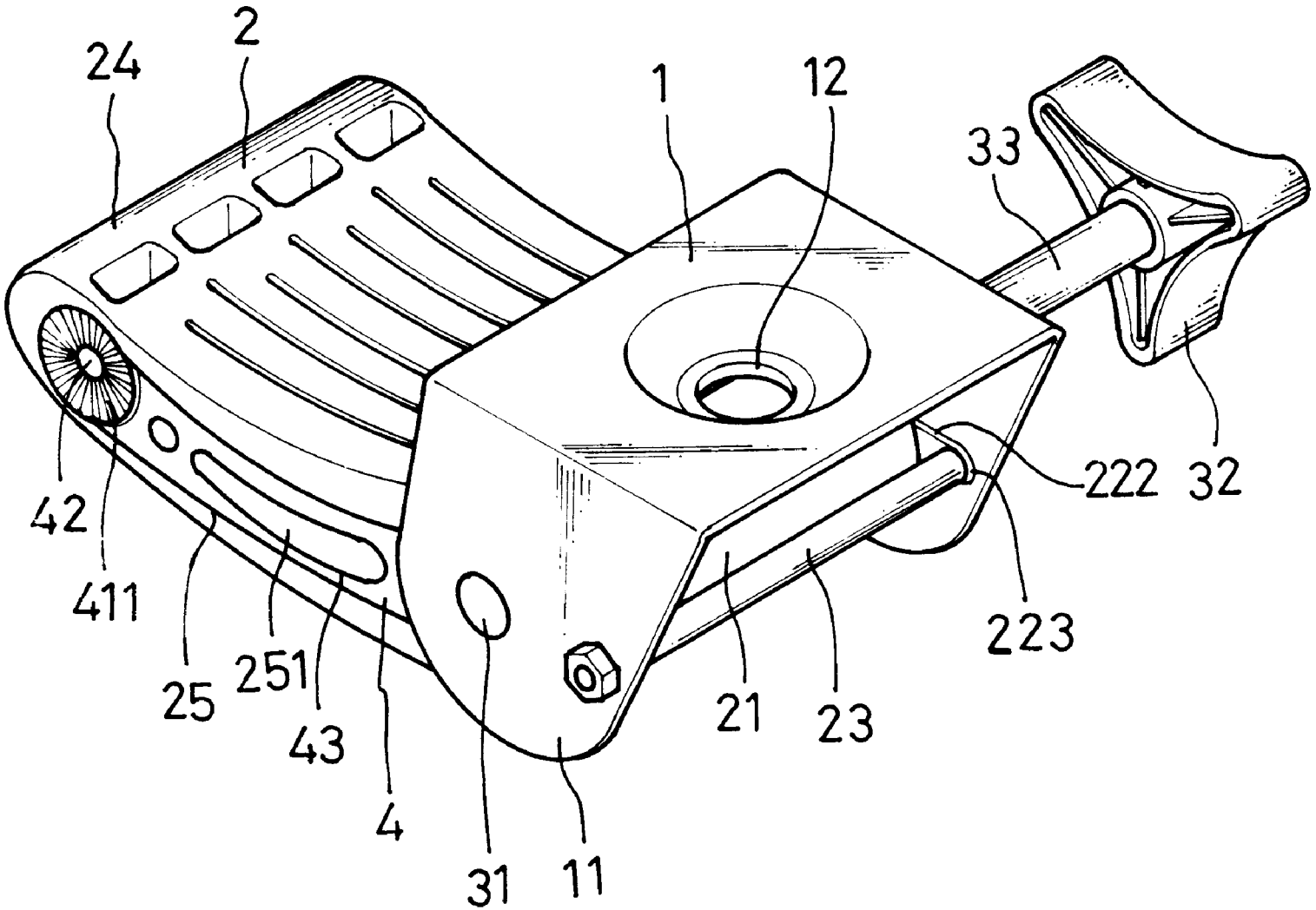
FIG. 4 is an assembled perspective view of the preferred embodiment.

In operation, when the shaft 31 and the knob 32 are in a locked state, the frame wings 11 clamp both sides of the front end seat 21 to position the connecting seat 2 therebetween (see FIG. 2). When the knob 32 and the shaft 31 are loosened, since the spring ends 221 of the springs 22 extend into the grooves 213, an end positioning effect is achieved. As for the spring coils 223, since they are connected to the frame wings 11, they are in a stationery state. At this point, the front end seat 21 utilizes the front axial hole 211 as axis to turn downwardly. When the baffle portion 215 contacts the spring post 222, the connecting seat 2 is prevented from any downward displacement, while the rear end seat 24 can still maintain a certain angle, which prevents the keyboard from falling off the keyboard support due to an unduly large inclination.

In addition, when the spring post 222 contacts the end stop portion 216, they define a largest angle and ultimate limit for upward displacement of the connecting seat 2.

Furthermore, in order to shield the springs 22 so that they are not exposed on the outside, reinforcement plates 4 are respectively inserted into recessed grooves 25 on both sides of the connecting seat 2. The reinforcement plates 4 are provided with front and rear plate holes 41, 42 corresponding to the front and rear axial holes 211, 241, with a plurality of projection receiving holes 43 distributed therebetween for receiving projections 251 on the recessed groove 25.

Furthermore, in order to achieve a good clamping effect between the rotary frame 1 and the reinforcement plates 4, inner walls of the wing holes 111 are provided with an annular toothed portions 113; outer walls of the front plate holes 41 are likewise provided with an annular toothed portion 411 to enhance the engagement and clamping effects.

In addition, in order to enhance the facility of use of the knob 32, an abutting tube 33 is disposed intermediate of the knob 32 and the frame wing 11 so as to provide an abutting or loosening effect.

In the present invention, when the tightening device is not in a tightened state, the baffle portions of the connecting seat will abut against the spring posts in the process of displacement to counteract the downward gravitational force, so that the keyboard support provided on the other side thereof will not, due to an unduly large angle of turning, cause the keyboard to fall. In addition, when the end stop portions of the connecting seat contact the spring posts, they define the uppermost limit for turning of the connecting seat. Besides, the arrangement of the reinforcement plates enhances the structural stress of the connecting seat, and the arrangement of the toothed portions can engage toothed portions of the rotary frame and the keyboard support, respectively, to enhance the clamping effect.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved connecting mechanism, comprising:

a rotary frame that is a substantially inverted U-shaped frame having frame wings on two sides thereof, said frame wings being provided with symmetrical wing holes;

a connecting seat that is a substantially curved structure having a front end seat and a rear end seat, said front end seat being disposed between said frame wings and having a through front axial hole in a transverse direction said front axial hole having two ends each of which is provided with an end recess that further communicates with a groove, said end recesses each having a baffle portion at a bottom end and an end stop portion at a top end, springs being fitted into said recesses, such that a first end of each of said springs is inserted into said groove, with a spring coil extending from a spring post at a second end thereof passing through a respective one of said end recesses to connect to a respective one of said frame wings, said rear end seat being formed with a through rear axial hole in a transverse direction;

a tightening device including a shaft and a knob, said shaft passing through said two wing holes, said two springs, and said front axial hole, said shaft being connected to said knob so as to be capable of abutting against said frame wings or moving away therefrom, whereby when said tightening device is not in a tightened state, said front end seat utilizes said front axial hole as an axis to turn downwardly, and when said baffle portions contact said spring posts, said connecting seat is prevented from downward displacement.

2. The improved connecting mechanism as defined in claim 1, wherein said rotary frame has a top face provided with a frame hole.

3. The improved connecting mechanism as defined in claim 1, wherein contact between said spring posts and said end stop portions defines a limit for upper displacement of said connecting seat.

4. The improved connecting mechanism as defined in claim 1, wherein said frame wings have through holes, and further comprising a frame rod passing through said through holes and said spring coils to thereby position said spring coils on said rotary frame.

5. The improved connecting mechanism as defined in claim 1, wherein said connecting seat has recessed grooves on opposite sides thereof, each of said recessed grooves having a reinforcement plate inserted therein, said reinforcement plate having front and rear plate holes aligned with said front and rear axial holes for passage of said tightening device.

6. The improved connecting mechanism as defined in claim 5, wherein said reinforcement plates further have a plurality of projection receiving holes distributed between said front and rear plate holes, and said recessed grooves are provided with a plurality of projections engaging said projection receiving holes.

7. The improved connecting mechanism as defined in claim 5, wherein said wing holes of said rotary frame have inner walls provided with an annular inner toothed portion, and said front plate holes have outer walls formed with annular outer toothed portions engaging said inner toothed portions to enhance the engagement and clamping effect of said rotary frame and said reinforcement plates.

8. The improved connecting mechanism as defined in claim 1, further comprising a tightening tube disposed between said knob and said frame wings, said shaft passing through said tightening tube to facilitate operation of said knob.

* * * * *